United States Patent [19]

Abell, Jr. et al.

[11] B 3,981,386

[45] Sept. 21, 1976

[54] NON RETURN TO HOME RACK SHIFT SELECTION MECHANISM FOR A SINGLE ELEMENT PRINTER

[75] Inventors: William A. Abell, Jr.; Thomas R. Field; Ralph A. Haus; Iraj D. Shakib, all of Lexington, Ky.

[73] Assignee: International Business Machines Corporation, Armonk, N.Y.

[22] Filed: Dec. 23, 1974

[21] Appl. No.: 535,391

[44] Published under the second Trial Voluntary Protest Program on January 27, 1976 as document No. B 535,391.

[52] U.S. Cl. ..... 197/18; 197/82; 197/96

[51] Int. Cl.[2] ..... B41J 23/04

[58] Field of Search ..... 197/16, 17, 18, 48, 197/49, 52, 55, 82, 84, 60, 89, 90, 96

[56] References Cited

UNITED STATES PATENTS

| | | | |
|---|---|---|---|
| 3,352,398 | 11/1967 | Crutcher et al. | 197/16 |
| 3,559,791 | 2/1971 | Waldenburger | 197/55 |
| 3,572,486 | 3/1971 | Hebel et al. | 197/55 X |
| 3,596,745 | 8/1971 | Waldenburger | 197/55 |
| 3,666,070 | 5/1972 | Schaefer | 197/18 |
| 3,738,471 | 6/1973 | Werff et al. | 197/16 X |
| 3,876,053 | 4/1975 | Giolitti et al. | 197/18 |

*Primary Examiner*—Edgar S. Burr
*Assistant Examiner*—R. T. Rader
*Attorney, Agent, or Firm*—Laurence R. Letson

[57] ABSTRACT

Disclosed is a mechanism for shifting the rack of a selection mechanism for a single element printer from one position to another in timed relationship to the translation of a barrel cam which provides the necessary mechanical input to control the amount of rotation of the typehead. The control of the rack shift mechanism is a cam arrangement operated in timed relationship with the translating barrel cam to provide for the shifting of the rack at the beginning of each print cycle, if necessary, and the retaining of the rack in its shifted position at the completion of the cycle, thereby eliminating the necessity to provide for the time required to shift the rack back to its home position at the end of the cycle. The elimination of the restore operation of the rack provides more time during the cycle to operate the selection mechanism and accomplish printing or conversely provides for a smaller amount of time being required for the necessary functions thereby providing the capability of operating the remainder of the mechanism at a faster rate.

1 Claim, 1 Drawing Figure

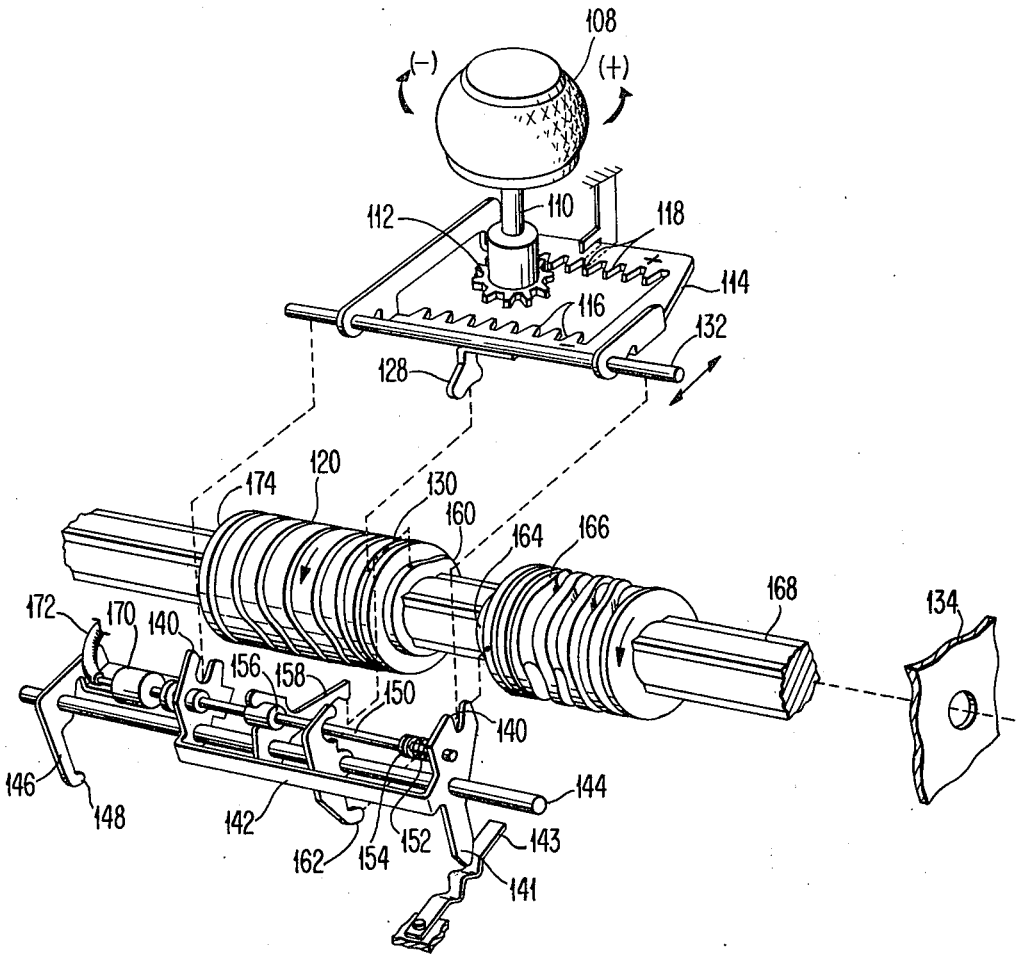
108
(−)
(+)
110
112
118
114
116
132
128
174
120
130
160
164
166
168
134
172
170
140
156
158
150
140
146
148
142
162
154
152
144
143
141

NON RETURN TO HOME RACK SHIFT SELECTION MECHANISM FOR A SINGLE ELEMENT PRINTER

RELATED CO-PENDING APPLICATIONS

"Printer with Non Return to Home Rack Shift Selection Mechanism," Ser. No. 535,406 co-filed herewith, Dec. 23, 1974, in the name of R. F. McDaniel, et al.

BACKGROUND OF THE INVENTION

As the selection mechanism for single element typewriters is incorporated into the print carrier for machine simplification and reliability, one approach has been to utilize a single translating rack element to provide, selectively, two directions of rotation to the typehead through a rack and pinion arrangement. One illustrative embodiment of this type of mechanism is to be found in Ser. No. 375,277 filed June 29, 1973 in the name of Iraj D. Shakib, titled *Single Print Element Print Carrier with Self Contained Selection Function.*

The disclosure of this co-pending application, Ser. No. 375,277, is hereby incorporated herein by reference, for an explanation of the mode of operation and structure as disclosed therein.

In the Shakib application, the rack is pivotly mounted and is rocked about its axis of rotation to provide for the engagement and disengagement of the rack teeth with the pinion. This is accomplished by means of, alternatively, electromagnetic or pneumatic elements.

In view of the actions of pneumatic elements only being able to act in one direction, it was necessary that the rack be restored to its home position at the completion of each operation.

The restoration of the rack to its home position at the end of each cycle required a nominal amount of time in each cycle which if eliminated could provide for greater flexibility.

The device disclosed in the Shakib specification, referenced above, required that time be allocated for a restoration of the rack mechanism at the end of each cycle. This allocation of time during any one print cycle restricted the ability to lengthen other operational times during the print cycle and therefore reduced design flexibility. Further, in requiring the time necessary to restore the Shakib mechanism, it, to some extent, restricted and hampered efforts to improve the speed of the mechanism.

OBJECTS OF THE INVENTION

It is an object of the invention to shift a bifurcated rack and thus control the direction of rotation of a pinion, only at the beginning of a cycle prior to any movement of a translatory mechanism for selecting a character on a single element typehead. It is another object of the invention to orient and engage a selected portion of a bifurcated rack with a pinion, regardless of which portion the rack was engaged, in response to the rotation of a cam member.

It is still another object of this invention to prevent the inadvertent shifting of the rack in mid cycle.

SUMMARY OF THE INVENTION

The disclosed device utilizes a rotating cam arrangement having multiple lobes such that when the cam lobes are controllably engaged with the followers and the followers enabled or disabled, the rack may be shifted in response to an external signal during the initial portion of the print cycle. As the cam which controls selection begins to rotate, the cam lobes also rotate and the follower is positioned so that one lobe will engage one leg and if the rack is in the wrong position, in response to the input signal controlling the follower, the follower and lobe engage and the follower rises providing the required mechanical input into the rack select mechanism to cause the rack to shift so that the other of the two racks becomes engaged with the pinion, thus conditioning the pinion for appropriate direction or rotation as the translating barrel cam begins its translation.

In the event that the last character required the same direction of rotation as the upcoming character the coupling means will be in a position such that it will not be engaged by the rise of the follower and cam lobe and thus no action will occur.

The foregoing and other objects, features and advantages of the invention will be apparent from the following more particular description of preferred embodiments of the invention, as illustrated in the accompanying drawings.

DRAWING

The FIGURE is an illustration of the best mode of implementation of the rack select mechanism.

DETAILED DESCRIPTION

The embodiment disclosed herein is an improvement of the embodiment disclosed in FIGS. 1–3 of the McDaniel, et al application, Ser. No. 535,406.

Referring now to the drawing, there is illustrated the best mode of the above disclosed invention.

The drawing illustrates a partially exploded view of the rack shift mechanism utilizing a camming arrangement and follower assembly all internal to the carrier. The advantage of this system is to place all the cams and followers inside the carrier system, thus reducing opportunity for damage and also the reduction of the necessary number of parts in order to build the device thereby making it more reliable.

The cams with their selection and tilt grooves are disclosed in the Shakib application, referred to and incorporated above.

To place impacted letters upon a record sheet, typehead 108 is provided. The typehead 108 is a spherical typehead with letters and numerals and other symbols arranged in a plurality of columns with a plurality of rows thus providing for all necessary characters, numerals and symbols.

Mounting typehead 108 is printhead rotate shaft 110. Attached to shaft 110 and providing a means to input rotational movement to shaft 110 in pinion 112. Pinion 112 is caused to rotate by rack 114 translating in a direction parallel to the axis of rotation of cam member 120. The same amount of translation of rack 114 will provide equal but opposite directions of rotation to pinion 112 depending on which rack 116 or 118 is engaged with the pinion at the time translation occurs.

Shift bail 132 is slideably engaged by openings in rack 114. Follower tab 128 depends from rack 114 and can engage groove 130 of cam 120 as indicated by the attached connecting line.

To provide input movement to shift bail 132 in a direction as indicated by the arrows at the right end of shift bail 132, shift forks 140 are provided. Shift forks 140 in the illustration are connected by a solid connecting member 142. Shift forks 140 are pivotally mounted on pivot rod 144 which in turn is fixedly attached to the frame of the print element carrier 134. Shift forks 140 are also rigidly attached to bell crank follower arm 146. At the end of bell crank follower arm 146 is cam follower 148. The selective engaging means or shiftable coupling member 150 is supported on shift forks 140. The selective coupling means is a rod member which is shiftable axially and parallel to pivot rod 144. The selective coupling means 150 is spring biased by means of an compression spring 152 and a collar 154 which is rigidly attached to rod 150. This spring provides the necessary compression force to restore rod 150 after it has been selectively displaced. Rod 150 carries on it an enlarged cylindrical area 156 which is capable of moving into a region of engagement with cam followers 158, 162. The drawing shows the enlarged cylindrical portion 156 is engaged with the cam follower 158. Cam follower 158 is pivotally mounted on pivot rod 144. The dotted connection extending from the end portion of cam follower 158 indicates its engagement with cam surface 160. The rise of cam 160 causes follower 158 to rotate upward and thus push enlarged portion 156 of engaging rod 150 downwardly and to the left. This motion causes shift forks 140 to rotate in a counterclockwise direction, as shown in the drawing, around pivot rod 144. With rack shift rod 132 engaged in fork 140 this cause the rack to shift and assume the position illustrated with rack teeth 118 engaged with pinion 112.

As can be readily seen from the drawing, if the enlarged portion or coupling sleeve 156 is shifted rightwardly such that it does not engage follower 158, follower 158 is then free to oscillate about pivot rod 144 with no effect on shift forks 140. To accomplish the shifting of the rack 114 to engage rack teeth 116 with pinion 112, follower 162 is provided and pivotally mounted on a pivot rod 144. Follower 162 engages a cam 164 which is preferably formed into the end of tilt cam 166. Cam 164 is rotationally positioned with respect to cam 166, such that its rise causes follower 162 to pivot at the same time as follower 158. However, inasmuch as in the previous explanations, cylindrical coupling surface 156 was engaged with follower 158, the follower 162 is ineffective to transmit any motion to the selectable coupling means 150. The selectable coupling means 150 which can be also described as selective interposer 150, when shifted rightwardly can engage follower 162 and thus couple the motion derived from cam 164 through follower 162 to the shift fork 140. Thus it can be seen that if it is desired to shift the rack 114 from condition as illustrated to a condition wherein teeth 116 are engaged with pinion 112, the coupling surface 156 is shifted rightwardly against the force of compression spring 152 and into an engaging region for follower 162. As this shifting occurs, cam 166 begins to rotate together with cam drive shaft 168. Inasmuch as there is no translation immediately upon the start of the rotation of cam 168, the rise of 164 remains in engaging region with 162 and thus causes 162 to rotate in a clockwise direction engaging sleeve 156 and imparting a clockwise movement to shift forks 140.

Shift forks 140 are provided with a detenting member 141 which engages a detenting spring 143 which in turn holds the forks in their detented position until physically moved by a camming force.

The shifting of interposer rod 150 and coupling surface 156 into and out of engagement with followers 162 and 158 may be accomplished by means of electromagnetic solenoids or by means of a pneumatic actuator. Illustrated in the FIGURE is a pneumatic actuator 170 provided with an input conduit 172. Pneumatic actuator 170 can receive a pneumatic pulse from a pneumatic logic element which provides the motive force for the expansion of this element, thus shifting interposer rod 150 and coupling cylinder 156 rightward. Upon the relaxation of the pressure in pneumatic actuator 170, spring 152 will restore interposer 150 and coupling cylinder 156 leftward to a state as illustrated.

On the leftward end of cam 120, a cam 174 positioned with respect to the remainder of the cam surfaces of cam 120, is formed. The positioning of the cam 174 is such that the follower 148 will engage that cam only when cam 120 has translated axially along cam drive shaft 168 leftward as far as possible; when a six unit rotation has been selected. The engagement between the rise of cam 174 and follower 148 is timed to occur at the point where the cam 120 is encountering a dwell and the rack 114 has translated to the maximum position it is capable of translating to. Thus when cam 174 acts on follower 148 the net effect is to shift rack 114 from a condition which is displayed in the drawing with teeth 118 engaged with pinion 112 to a condition where the shift forks 140 are rotated in a clockwise direction about pivot shaft 144. The shifting accomplished by cam 174 and follower 148 together with bell crank 146 is the necessary function to accomplish a case shift and thus rotate typehead 108, 180° from its rest or home position.

As can be understood from the foregoing discussion, cams 160 and 164 accomplish the shifting of rack 114 at the beginning of a print cycle and the rack 114 remains in its displaced position regardless of which set of rack teeth 116 or 118 are engaged with pinion 112 at the completion of the cycle. The rack is only switched on the succeeding cycle if necessary and if it is already engaged with the appropriate teeth, the followers 162 and 158 have no displacing effect but go through their cycle of operation together with the shifting or non-shifting of interposer 150 and coupling surface 156, merely to insure the proper rack position as is controlled by pneumatic element 170. It should be appreciated that a solenoid could be substituted for the pneumatic device by merely reversing the designated positions of the followers, such that the solenoid would attract interposer 150. Such rearrangement and substitution of activating element is well within the skill of the art and will be clearly understood by one skilled in the typewriter art.

OPERATION

As an example of the operation of the device, assuming that a character is selected which will require a negative rotation as illustrated in the drawing, a requirement exists that rack teeth 116 be meshed with pinion 112. Assuming that the preceeding character has required a positive rotation and that the rack is in a condition as illustrated, simultaneous with the logic signals received from the logic unit to activate the selection pins for rotate and tilt, a signal, either a pulse or no pulse is connected to and fed to pneumatic element 170. In the case of a letter requiring negative rotation for selection, a pulse of pressurized air is conducted through conduit 172 to pneumatic element 170 forcing interposer 150 and coupling surface 156 to shift rightward. Shortly after the receipt of the pneumatic logic output defining the selection to occur during the next machine cycle, the machine is cycled as is described in the Shakib specification, referenced above, and shaft 168 begins to turn.

During the early portions of the cycle, no lateral translation of cams 120 or 166 occurs. It is during this time that cam 160 and cam 163 act on their respective followers 158 and 162. Inasmuch as coupling surface 156 has been translated rightward into engaging region with follower 162 and out of engagement with follower 158, follower 158 is ineffectual. Follower 162 deriving a clockwise motion from the rise of cam 164 forces itself against coupling surface 156 and effects a clockwise rocking of shift forks 140 around pivot rod 144. Detent member 141 is shifted over the detenting rise of spring 143 to maintain shift forks 140 in the displaced position. As a direct result of the shifting of shift fork 140 in a clockwise direction around pivot 144, shift rod 132 translates upwardly and to the right, thus forcing rack 114 in the same direction and disengaging rack teeth 118 from pinion 112 and engaging rack teeth 116 with pinion 112. As cam drive shaft 168 continues to rotate selection and printing occurs as is described in the Shakib specification. Upon the completion of the one revolution of cam drive shaft 168, rack 114 remains in its displaced position for negative rotation.

By this time, the actuating device 170 has ceased to receive pressurized pneumatic signals and has relaxed thus allowing spring 152 to return interposer 150 and coupling surface 156 to their normal position. If the next character selected at the keyboard requires a negative rotation, interposer 150 and 156 will be shifted rightwardly and no change in the position of rack 114 will occur. However if the next character requires a positive rotation, no signal will be received by pneumatic element 170 and then coupling surface 156 will be in a position to receive the motion of follower 158 derived from the movement of cam 160 in a counterclockwise direction thus rotating shift forks 140 in a counterclockwise direction and repositioning rack 114 into a position as shown.

To accomplish case shift, the selection mechanism translates the case shift command into a plus six unit rotation. A plus six unit rotation will cause the rack 114 to be engaged substantially as shown, or if the preceeding character involved a negative rotation, the shifting of the rack is above described. Then as cam 120 translates leftwardly along the axis of cam drive shaft 168, cam 174 will come into operative engagement with follower 148. Together with follower 148 the rise of cam 174 causes follower bell crank 146 to rotate clockwise around pivot rod 144 and impart that motion to shift forks 140 thus shifting rack 114 to engage rack teeth 116 with pinion 112. The rise of the cam 174 is timed by placing it rotationally with respect to the selection cam grooves of cam 120, to occur during the high dwell, such that the rack 114 is substantially stationary during the shifting phase.

The six unit rotate in a positive direction is dedicated to the shifting of case and does not have any character selection associated therewith and therefore allows for the switching of rack 114 at mid-cycle.

If a negative six unit of rotate is selected, the shift forks 140 and bell crank 146 are spacially oriented in a clockwise position with detent member 141 engaging the lowermost detenting positions on spring 143 and thus follower 148 will not engage cam 174 since it will be displaced radially outward from the axis of the cam.

While the invention has been particularly shown and described with reference to preferred embodiments thereof, it will be understood by those skilled in the art that the foregoing and other changes in form and details may be made therein without departing from the spirit and scope of the invention.

We claim:

1. A printer having a type element mounted for rotation to present different characters to a print position, a pinion connected to said type element for rotation therewith, a drive device comprising a pair of rack members alternately positionable to engage diametrically opposite portions of said pinion, and means for driving an engaged rack member a measured distance wherein the improvement comprises:

a rack selection mechanism for shifting said rack members into and out of engagement, said rack selection mechanism comprising a pivot member spacially fixed with respect to said printhead;

a first cam follower means pivotally mounted on said pivot member;

a second cam follower pivotally supported on said pivot member;

a third cam follower pivotally supported on said pivot member;

said first cam follower means supporting for monoaxial displacement relative thereto, a selectably displaceable member for coupling said first cam follower means alternatively with said second and said third cam followers;

said first cam follower means positively engaging said drive device to impart bidirectional movement to said drive device;

a first cam, rotationally engageable with said first cam follower;

second cam rotationally engageable with said second cam follower, said first and second cam followers spacially displaced such that said first and second followers can not be simultaneously engaged by the respective first and second cams;

third cam engageable with said third cam follower to shift said first cam follower about said pivot member when said displaceable member is engaged with said third follower, said cams being axially movable into and out of engagement with said respective followers.

* * * * *